United States Patent [19]

Dorow

[11] Patent Number: 4,546,702

[45] Date of Patent: Oct. 15, 1985

[54] APPARATUS FOR HOLDING PRINTING PLATES ON THE CYLINDER OF A PRINTING PRESS

[75] Inventor: Joachim Dorow, Frankenthal, Fed. Rep. of Germany

[73] Assignee: Albert-Frankenthal AG, Fed. Rep. of Germany

[21] Appl. No.: 595,107

[22] Filed: Mar. 30, 1984

[30] Foreign Application Priority Data

Apr. 28, 1983 [DE] Fed. Rep. of Germany ..... 3315488

[51] Int. Cl.[4] ..... B41F 27/12

[52] U.S. Cl. ..... 101/415.1; 101/378

[58] Field of Search ..... 101/378, 415.1

[56] References Cited

U.S. PATENT DOCUMENTS

| | | | |
|---|---|---|---|
| B 351,939 | 1/1975 | Dauner | 101/378 |
| 2,051,858 | 8/1936 | Huck | 101/415.1 |
| 2,056,991 | 10/1936 | Tomlin | 101/415.1 |
| 2,105,452 | 1/1938 | Busk | 101/415.1 |
| 2,684,029 | 7/1954 | Friesz | 101/415.1 |
| 2,965,025 | 12/1960 | Mueller | 101/415.1 |
| 3,824,928 | 7/1974 | Langer | 101/415.1 |
| 4,223,604 | 9/1980 | Brehm | 101/383 |

FOREIGN PATENT DOCUMENTS

| | | | |
|---|---|---|---|
| 72537 | 1/1969 | German Democratic Rep. | 101/415.1 |

*Primary Examiner*—Clyde I. Coughenour
*Assistant Examiner*—William L. Klima
*Attorney, Agent, or Firm*—Jones, Tullar & Cooper

[57] ABSTRACT

In the case of a device for holding offset or other plates on the plate cylinder of a printing press with two clamping members on the two sides of a well running in the axial direction of the cylinder and each having a gripping part of clamping the hooked ends of the plate and at least one of the members may be rocked about an axis parallel to the axis of turning of the cylinder, the necessary width of the well may be greatly decreased in the clamped condition of the system of one of the clamping members, that is able to be rocked, takes the form of a segment bar having a cross-section that is generally three-sided and segment-like. This bar may be placed next to an outer face of the cylinder body and has an outer face lined up with and continuing the outer face of the cylinder body. The segment bar further has a convex, part-cylindrical base face at a limit of the outer face of the bar, the convex base face fitting into a socket therefore in the cylinder body, the socket being part-cylindrical and concave with a curvature in keeping with the form of the convex face. Because the well is narrow there is more space for the printing image on the plate cylinder.

9 Claims, 4 Drawing Figures

APPARATUS FOR HOLDING PRINTING PLATES ON THE CYLINDER OF A PRINTING PRESS

BACKGROUND OF THE INVENTION

The present invention relates to systems for mounting plates, more specially offset lithographic plates with stretch properties, on the plate cylinder of a printing press. In the prior art such a system may be made up of a well running along the length direction of the cylinder and having clamping members placed on its two sides, each of such clamping members having its own gripping part for gripping the hooked ends of the printing plate, and at least one of the clamping members is able to be rocked about an axis parallel to the axis of turning of the cylinder in the printing press.

A system designed on these lines is for example to be seen in the German Pat. No. 2,759,434. In this known system the rocking clamping member is in the form of a rocking flap of L-like cross-section which was able to be rocked about an axis at the side of the well. Using the rocking flap the hooked edge part of the plate was pulled into the well over the edge thereof. A shortcoming of such known systems was the fact that the well had to be made quite broad in the round-the-cylinder direction so that a large part of the cylinder would necessarily not have any printing plate, and for this reason any printing image thereon so that the press would be less economic to run. A further point to consider was that the plate was likely to be bent on being put on and taken off the cylinder so that it would then be damaged and useless for further printing. A still further shortcoming was that the rocking mounting flap was not able to be locked in place and was only acted upon by a stack of springs moving it into the plate-fastening position. Such springs might then be caused to vibrate in operation and the plate would then no longer be firmly seated on the plate cylinder.

GENERAL OUTLINE OF THE PRESENT INVENTION

In view of this present stage of development of the art one of the purposes of the present invention is that of designing a plate mounting system of the sort noted that is a step forward inasfar as there is not only a relatively narrow strip on the plate cylinder on which there is no printing image but furthermore it is generally not possible for the ends of the plate to be bent and so damaged.

At the same time the press cylinder is to be more simply and readily operated by the pressman.

For effecting these and further purposes in the present invention one of the clamping members, that is able to be rocked, takes the form of a segment bar having a cross-section that is generally three-sided and segment-like, this bar being placed next to an outer face of cylinder body and having an outer face lined up with and continuing the outer face of the cylinder body, the segment bar further having a convex, part-cylindrical base face at a limit of the outer face of the bar, the convex base face fitting into a socket therefor in the cylinder body, the socket being part-cylindrical and concave with a curvature in keeping with the form of the convex face and adjoining the outer face of the cylinder.

With such a design of the press one may be certain that the plate will be mounted load-bearingly perfectly evenly and without any steps under it, not only on the outer face of the cylinder body but furthermore on the segment bar forming a continuation of the cylinder outer face. In fact, the plate will be perfectly supported for its full length from one hooked end to the other so that all of it may be used for the printing image. At one and the same time it is possible for the gripping edge of the rocking segment bar to be swung outwards from the position in which it is lined up with the outer face of the cylinder when the plate is to be mounted or taken off the cylinder, this effectively putting an end to damage through deformation of the plate ends so that same may be used again. A further point is that this makes it possible for the well in the outer face of the cylinder between the clamping members to be made very narrow or more or less completely closed so that the breadth of the non-printing strip will only be that part of the cylinder over the rounded form of the clamping edges. Notwithstanding this the system is still simply and quickly operated, seeing that the gripping segment bar, that may be rocked out of the position in which it is lined up with the outer face of the cylinder, may be readily got at and it is not necessary for the pressman to put his fingers or a tool into the narrow well. The observations made so far on the design of the invention will make it clear that the objects of the invention may be effected with simple and low-price means.

As part of a useful further development of the invention the cylinder body may have a stop face against which an arm or lever on the segment bar may be forced by a cam shaft in the plate clamping position, the cam shaft being mounted by bearings in a cylinder body and being able to be locked in relation thereto. Using this cam shaft there is the useful effect that a relatively large clamping force may be made to take effect so that the segment bar is dependably moved into the position with the arm on the stop and in which its outer part-cylindrical face is lined up with the outer face of the cylinder body without the very least discontinuity or step therebetween.

In keeping with a still further useful outgrowth of the present invention the arm or lever is made up of a number of arm members that are spaced out along the length of the cylinder with each arm member running past the convex base face towards the clamping member diametrically opposite to the clamping edge. Each of the arm or lever members is furthermore taken up in a groove with a stop face therein and may be moved by a cam on a cam shaft running continuously along the segment bar. With such a design it is possible to be certain that the construction is highly rigid and is free of any deformation so that there is more specially an even pulling force all the way along the full breadth of the plate, this being highly welcome in the case of very broad plates.

A further useful effect is to be had if the cam shaft is so designed and placed that the arm or lever members may be moved over back sides of the cams thereon and moved completely clear of the cams when they are turned out of their plate mounting positions. This greatly increases the range through which the segment bar may be rocked so that the clamping edge thereon may be moved a long way outwards past the position in which it is lined up with the outer face of the cylinder.

As part of a still further development of the invention the rocking segment bar has a hexagonal head, or other structure that may be turned by a tool, on at least one of its ends on its axis of curvature of the convex base face of the bar. This design makes it a simple matter to turn the segment bar with the help of a spanner used at a position clear of the cam shaft. At the same time there is the useful effect that the segment bar may be worked from the end of the cylinder so that the well may be made smaller in size.

To make certain that the segment bar, whose convex face is rested in the socket in the cylinder body, is kept in an exactly true position it is possible to have cheekpieces interlocking with its ends, such cheekpieces being fixed on the cylinder body and having faces fitting against the bar that are concentric with the convex face of the segment bar.

In keeping with a still further outgrowth of the invention the gripping parts used with the clamping members may take the form of rocking rails that are two-armed in cross-section and supported on a pivot shaft on the clamping member in question, the radially inner arm of the rocking rail on the segment bar having a head turned towards the other rocking rail, such head being pushed against the radially inner arm of same on motion of the segment bar in the direction needed for dismounting the plate from the cylinder. The design of the gripping parts in the form of rails, that each are more specially made in long lengths, makes for a strong and dependable gripping effect on the plate. At the same time however the design makes certain that the rocking rails are automatically moved into their open positions for taking the plate off the press cylinder so that the plate clamping system is more easily operated. A still further useful effect due to having rocking rails with a two-armed cross-section is that the parts may be simply worked by the use of an eccentric shaft.

A still further useful effect is to be produced if the continuous shafts, running all the way from one end of the cylinder to the other, for supporting the rocking rails (that best subdivided at the stages), and the eccentric shafts are supported on stages on the clamping members spaced out along the length of the cylinder in the well so that the pivot and cam shafts are supported at a large number of points along their lengths and they will not be bent in the case of long cylinders.

Further useful developments and outgrowths of the main teaching of the invention will now be made clear from the account of one working example thereof to be seen in the figures and from the claims hereof.

LIST OF THE DIFFERENT VIEWS OF THE FIGURES

DETAILED ACCOUNT OF THE WORKING EXAMPLE OF THE INVENTION

Figure 1:
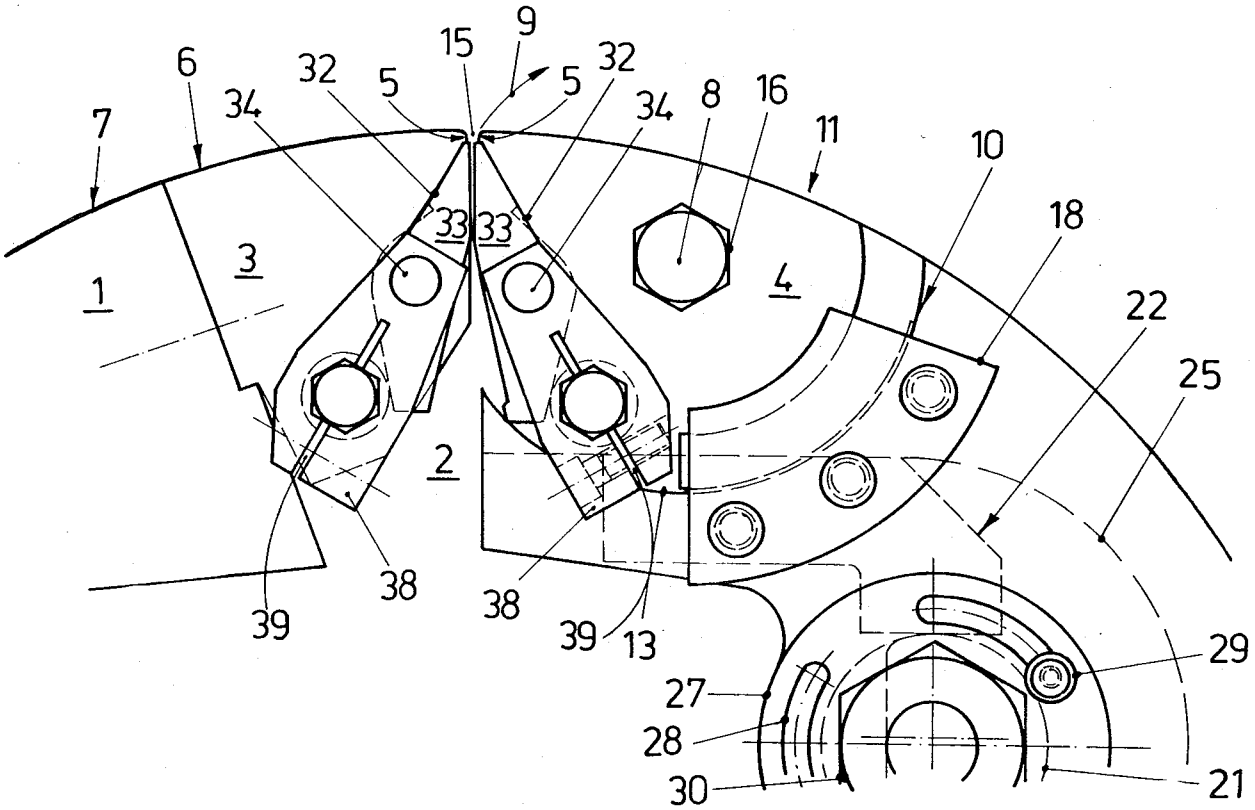
FIG. 1 is a part view of an offset printing machine plate cylinder in its plate clamping or holding condition, the cylinder being fitted with a plate mounting system in keeping with the present invention.

The general design and manner of operation of a web-feed printing press being familiar, there is no need to give any detailed explanations in this respect. The plate cylinder, running against a blanket cylinder, has a plate holding means for fixing in place and pulling tight the offset printing plate on it. As will be more specially clear from FIGS. 1 and 2, the plate holding means is made up of two clamping members 3 and 4 that are placed on the two opposite sides of a well 2 formed in the outer face of the plate cylinder body and running in the axial direction thereof from end to end, the members 3 and 4 narrowing in section radially outwards towards blunt, rounded edges referenced 5 over which the ends of the offset plate are to be trained. In the present working example the clamping member 3 to be seen on the left in FIG. 1 is firmly joined to the cylinder body 1 by being made in one piece with the rest of the cylinder body 1 or, as in the present case, screwed to the cylinder body 1. The outer face 6 of the stationary clamping member 3 has the same curvature as the outer face 7 of the cylinder body 1 and forms a continuation of the outer face 7 of the body 1 without any step or gap therebetween. The clamping member 4 to be seen on the right of the fixed member 3 may be rocked about a virtual axis 8 that is parallel to the axis of turning of the plate cylinder and placed at some radial distance therefrom; on rocking this member 4 may be moved so that its blunt gripping edge 5 is pulled away from the position opposite to the gripping edge 5 of the clamping member 3 as in FIG. 1 in which the member 4 is lined up with the outer face of the cylinder body 1 (as in FIG. 1) into the outwardly rocked position to be seen in FIG. 2.

The rocking clamping member 4 has a sort of three-sided cross-section, with one of its sides made part-cylindrical, so that the member is herein named a segment bar. By the nature of things its blunt edge 5 or crest is joined up by the radial inner and outer side faces with a base face 10. The radially outer side face of the segment bar 4 has a curvature 11 the same as the curvature of the outer face 7 of the plate cylinder so that the plate-gripping position viewed in FIG. 1 the outer face of the bar 4 takes the form of a smooth continuation of the outer face 7 of the cylinder body 1 without any step thereat or any gap therebetween. The base face 10 is convexly curved in relation to the virtual axis 8 of rocking. The base face 10 runs in a concave socket 13 with a socket face 12 having the same radius. The outer face, having (as noted) the same radius of curvature as the outer face of the cylinder body, of the segment bar 4 comes to an edge of the convex base face 10, in the same way as the outer face 7 of the cylinder body 1 comes to an end of the concave running socket face 12 as a continuation of the outer face 7 of the cylinder body 1. At the joint between the base face 10 and support face 12 there is only a line between the two parts without, as noted, any physical interruption therebetween so that the offset printing plate wrapped around the outer face of the cylinder body and segment bar will be evenly supported at all points of its inner face of the outer face of body.

In the pulled-tight position the offset plate (that is not marked to make the figures simpler) on the outer face of the cylinder body 1 the plate is not only supported on the cylinder body in the limited sense of the word but furthermore on the clamping member 4 as formed by the segment bar and on the stationary clamping member 3, this making it possible to make full use of all of the length of the plate between the mounting hooks thereon. To mount a plate on the cylinder and to take it off the cylinder again the rocking segment bar 4 is moved into the position of FIG. 2, in which its gripping edge 5 is swung up clear of the plane of the outer face of the cylinder body so that it is simpler for the pressman to get at the gripping edge 5 and to put the hook of the plate on the segment bar 4 without danger of deformation. To tighten up the plate, the plate gripping edge 5 of the segment bar 4 is moved in the direction of the arrow 14 (in FIG. 2) so far inwards that the outer face or side of the bar 4 with the curvature 11 is fully in line with the outer face 7 of the rest of the cylinder body and a smooth continuation thereof, this being made clear in FIG. 1. In this position the gap 15 between the gripping edges 5 next to each other is generally so small in size that the strip-like non-printing area produced thereby is only limited by the size of the rounded, bent edges of the printing plate.

Figure 3:
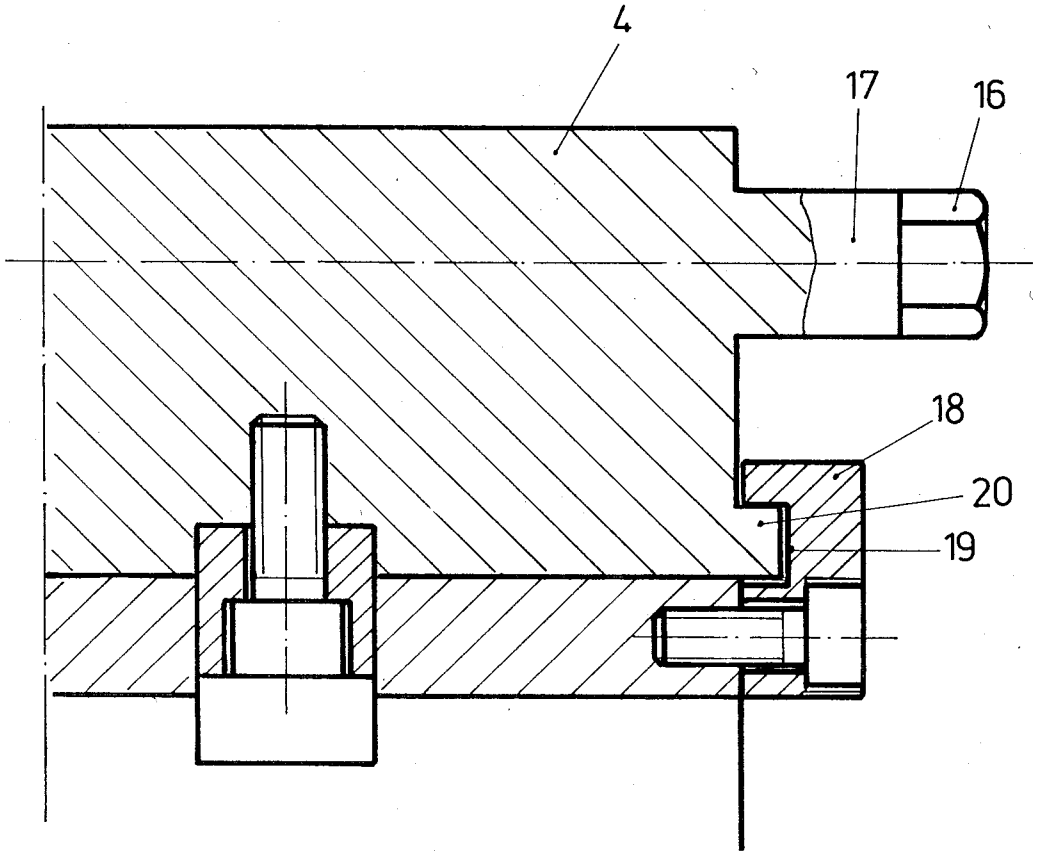
FIG. 3 is an axial section through the rocking segment bar as mounted in place in the cylinder.

For rocking the segment bar 4 it may be fitted with a toggle lever system supported on the cylinder body. In the present working example however the segment bar 4 has a simpler driving system in the form of a hexagonal head 16 placed at one end thereof so that it may be turned by a spanner. The hexagonal head 16 is centered on the virtual axis 8 of turning of the segment bar 4 that is supported on its base face. As will be seen from FIG. 3 the hexagonal head 16 simply produced by machining a pin 17 running out from the end of the bar 4. It is only necessary to have such a driving head on one end of the bar 4. In place of the hexagonal head 16 it would furthermore be possible to have an allen key socket of hexagonal form, although the head with outer hexagonal flats is more simply manufactured. To keep the segment bar 4 having its base face 10 running on the support face 12 of the cylinder body 1 in place, it is possible, see more specially FIGS. 1 and 3, to have gripping cheekpieces 18 fixed on the end faces of the cylinder body 1, such cheekpieces 18 each having a guide groove 19 for locking onto a lip 20, with the same curvature, on the segment bar 4.

In the last stage of its rocking motion before getting into the plate-tightened condition, that is to say the true tightening stage, the segment bar 4 is not moved by turning it with a spanner on the hexagonal head 16 but by turning a cam shaft 21 mounted by bearings (not shown) in the cylinder body 1, such shaft giving all the necessary mechanical advantage or leverage to make light work of the tightening stage. The offset plate to be mounted on the cylinder body and pulled tight may for this purpose be so angled at its ends to form hooks thereon that the size of the plate in the loose condition between the edges is somewhat smaller than the size thereof in the pulled-tight condition on the gripping edges, that is to say the plate is bent so as to be somewhat undersize. The tightening force then acting on the plate and produced by the segment bar 4 makes it possible for the plate to be stretched to some degree, enough to see that the plate is in fact resting firmly on the outer face of the cylinder body. The cam shaft 21 used for producing such a pulling or tightening force takes effect on a lever 22 fixed on the segment bar 4, such lever 22 being on the opposite side of the virtual axis 8 to the gripping edge 5. The pulled-tight position is defined by a stop face 23 on the cylinder body and against which the lever 22 is forced by the cam shaft 21 acting thereon, this being marked in FIG. 2 by broken lines.

Figure 4:
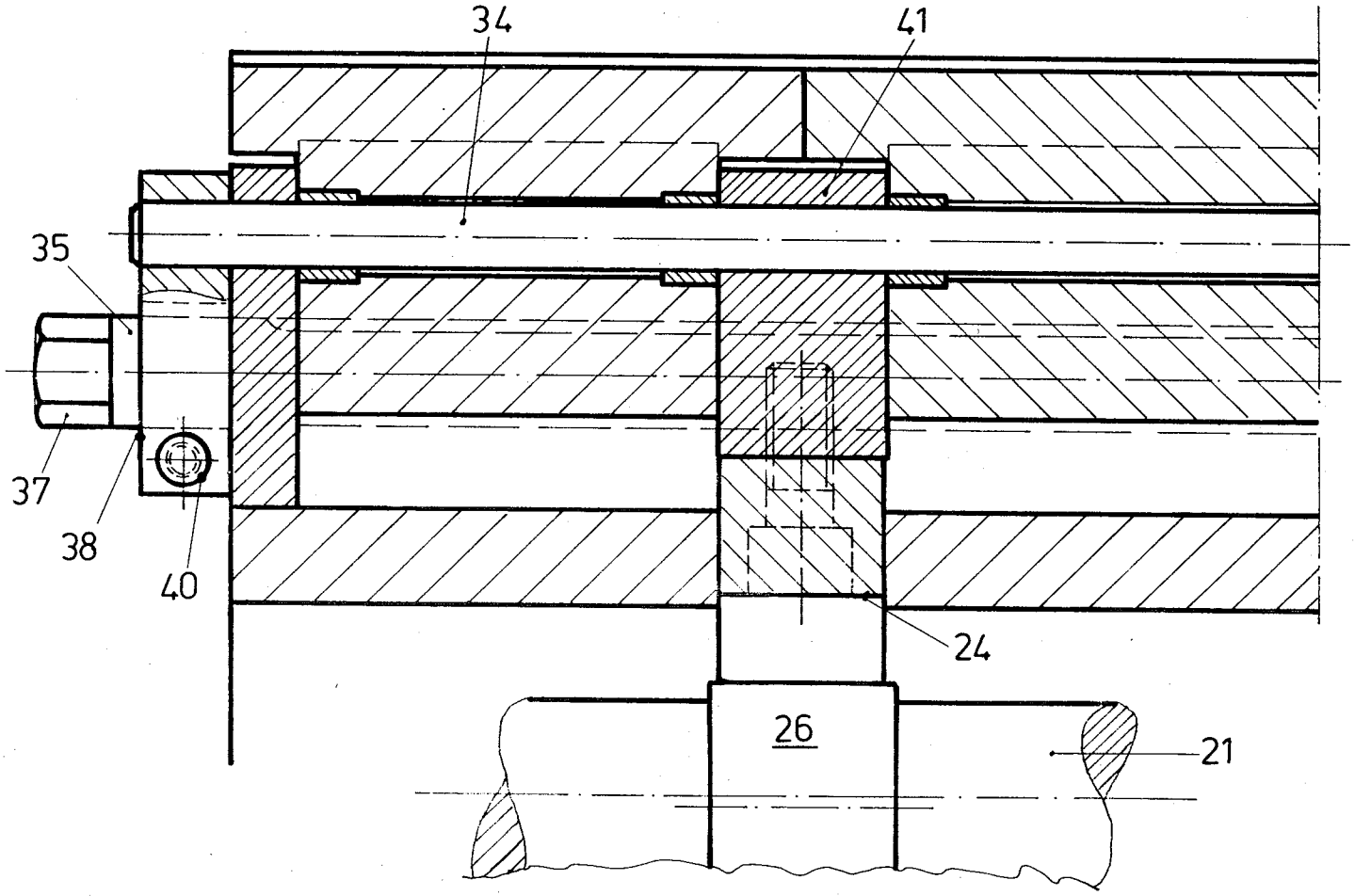
FIG. 4 is an axial section as taken through a gripping part with two cheekpieces functioning as a locking means.

The lever 22 is in the present working example made up of a number of lever members 24 evenly spaced out along the length of the segment bar 4 and running out past the base face 10 of the bar 4, such members fitting into separate grooves 25 in the cylinder body with stop faces 23. The cam shaft 21 stretches along the full length of the segment bar 4 with which it is used and has one cam 26 for each lever members 24, as may be most clearly seen in FIG. 4. In the pulled-tight position the cam shaft 21 is locked so that it may not be turned. To this end, see FIG. 1, the cam shaft 21 has a locking cuff 27 resting on the end face of the cylinder body, such cuff having curved slots 28 to take up locking screws 29. Such screws may be tightened to lock the locking cuff 27 firmly against the cylinder body 1 so that the cam shaft 21 may then not be turned in relation to the body. When the locking screws 29 are loosened the cam shaft 21 may be turned by a spanner as well. To make this possible the cam shaft 21 has a hexagonal head 30 with the locking cuff 27 at one or more ends, especially, at both ends (so that there would then be two cuffs 27) for use with such a spanner.

Figure 2:
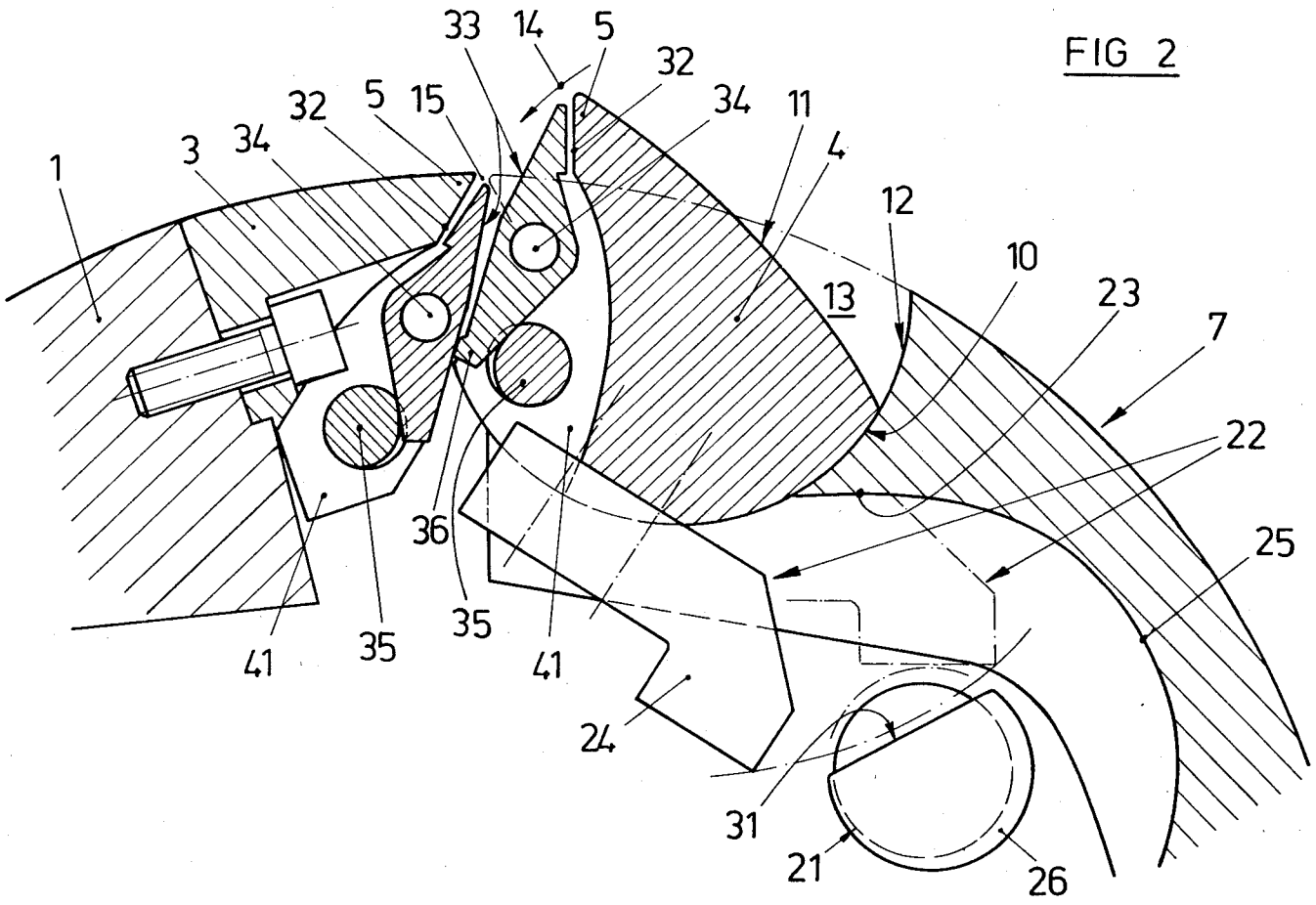
FIG. 2 is a section, taken parallel to the end of the plate cylinder in keeping with FIG. 1, in the condition ready for taking a plate off the cylinder or putting a plate in place thereon.

The cam shaft 21 may be seen more specially from FIG. 2 to be placeed at such a distance from the virtual axis 8 of turning of the segment bar and has such a flat 31 on the side opposite to the cam 26 that the lever members 24 to be used therewith may be moved past the flat 31 in the position of the cam shaft to be seen in FIG. 2 in full lines. This is to make certain that the segment bar 4 may be kept completely clear of the cam shaft 21 so that it may be rocked through a large angle. For such rocking to take place the cam shaft 21 is simply to be turned out of the position to be seen in FIG. 2 and marked in broken lines through 60° into the clear position to be seen in full lines.

In the present working example the segment bar 4 is to be so designed that it runs along the full length of the cylinder. In the case of double width machines the segment bar 4 might be made in two lengths each equaling the width of one plate. To make it possible for the different lengths thereof to be worked separately, each length might have its own cam shaft that would be able to be worked from one end of the cylinder or from the two ends thereof. In the case of operation of the two cam shafts from one and the same end of the cylinder, the one cam shaft for the cylinder in question would be made hollow and take up a driving tailpiece on the other cam shaft for operation of the cylinder part further from the said cam shaft end.

To make certain that the printing plate is fully locked in place without any chance of slip, the gripping edges 5 have gripping parts for pressing the hooked edges (formed by angling) of the plate to be mounted on the press on a vise face 32 on the gripping edge 5 in question so that the plate is quite safely kept in place. The gripping parts are in the present case rocking rails 33, each placed on one of two shafts 34 running from one end of the cylinder to the other and supported on the clamping members. The shafts 34 are placed between the inner and outer edges of the rails 33. When looked at in section each such rail may be thought of as having two arms running out from its shaft 34, the outer arm having a vise face opposite the vise face 32 on the gripping edge so that the edge of the plate may be gripped between them. Operation of the rocking rails 33 is caused in each case by an eccentric shaft 35 acting on its radially inner end. The radially inner end of the arm of the rocking rail 33 next to the segment bar 4 will be seen more specially from FIG. 2 to have a head 36 for use with the opposite rocking rail 33 such that when the segment bar 4 is moved in the direction of arrow 9, that is to say for freeing the plate, the head 36 runs up against the rocking rail 33 used with the stationary clamping member 3 and the outcome of this is that when the segment bar 4 is moved in its plate-freeing direction the rocking rails 33 push each other into their open positions if the eccentric shafts 35 thereof have been earlier moved into the plate freeing position, this making operation of the system very simple and straightforward. In this case as well the design may be such that there are nut-like heads for the operation of the eccentric shafts by using a spanner. As will be seen more specially from FIGS. 1 and 4 each or both ends of the eccentric shafts 35 have hex heads 37 that are simple to get at from the ends of the cylinder. For locking the eccentric shafts 35 in position there are locking bars 38 fixed round the ends of the shafts 35 in each case. The locking bars are to be seen more specially from FIG. 1 to have slots 39 so that they may be done up tight on the end of the eccentric shaft in question by way of a tightening screw 40. The shafts 34 and the eccentric shafts 35 run from one end of the cylinder to the other so that to stop sagging of such shafts it is necessary to have bearings placed spaced out between their ends. For this purpose the stationary clamping member 3 and the moving clamping member 4 as formed by the rocking segment bar have stages 41 to take up the shaft 34 and the further eccentric shaft 35. The stages 41 may be seen from FIG. 4 to have the further function of stabilizing the lever members 24. The rocking rails 33 placed on one of the shafts 34 may, as is further to be seen from FIG. 4, be subdivided at the stages 41 to make production simpler.

For mounting a plate on the cylinder and taking it off again it is firstly necessary for the eccentric shafts 35 and the cam shaft 26 to be moved into their release positions to be seen in FIG. 2. Next the segment bar 4 is moved out into the position to be seen in FIG. 2 so that the gripping rails are opened and then kept in the open position so that the old plate may be taken off the press and a new plate mounted thereon. In this respect the angle edge hooks of the plate are placed between the vise faces of the rocking rails and the clamping members placed next thereto. Then the eccentric shafts 35 are turned into the clamping position after turning back the segment bar 4 somewhat if desired. Because the head 36 is moved up against the gripping rail 33 next to the stationary clamping member 3, in the present working example of the invention in a further stage of operation (not shown) of the eccentric shaft 35 the segment bar 4 (clamping member) is automatically turned back so that it is not necessary for the bar 4 to be turned back separately. After the plate has been clamped in place the segment bar 4 is placed against the cam shaft 21 and then the cam shaft is turned so that the segment 4 is then moved into a plate-tightening position as defined by a stop.

In the present working example of the invention the cylinder body 1 is a single-piece structure. However it would be possible for the cylinder body 1 to be made in the form of a section fixed to the cylinder shaft and stationary in relation to it, and a further section able to be rocked about the said shaft. The axis 8 of the segment bar 4 is spaced from but parallel to the shaft of the plate cylinder. In the case of one design on these lines the plate tightening force may be increased still further by rocking the section, pivoted on the cylinder shaft, of the cylinder body 1.

I claim:

1. In an apparatus for fixing a printing plate on a plate cylinder body at two sides of a well running generally continuously in the axial direction of the plate cylinder body, said plate cylinder body being supported for turning about a cylinder axis, comprising:

two clamping members adapted to take effect on two separate hook-like bent ends on the printing plate, said clamping members being placed on said two sides of said well;

pivot means rockingly supporting at least one of said clamping members for rocking motion thereof about an axis that is parallel to the cylinder axis, said rockingly supported clamping member taking the form of a segment bar having a cross-section that is generally three-sided and segment-like, said bar being placed next to an outer face of said cylinder body, and having an outer face lined up with and continuing said outer face of said cylinder body, said segment bar further having a convex, part-cylindrical base face at a limit of said outer face of said bar, said convex base face fitting into a socket therefor in said cylinder body, said socket being part-cylindrical and concave with a curvature in keeping with the form of the said convex face, and adjoining said outer face of said body;

separate gripping parts each adapted for use with one of the clamping members, said gripping parts are in the form of rails running along said well, each rail having a radial cross-section in the form of a radially outer arm and a radially inner arm joined together at a rocking axis defined by said rail, each said rail being rockingly supported on a different one of said clamping members for rocking about said axis;

two pivot shafts on which said rails are supported for rocking motion;

two excentric shafts each for acting on one of said gripping parts and causing same to grip one of the hook-like ends of the printing plate, each said eccentric shaft having an end structure adapted to be turned by a tool; and locking bars for acting on ends of said eccentric shafts for locking same in a given position of turning, said locking bars having holes therein taking up ends of said pivot shafts on which said rails are supported, wherein:

one of said rails has a head facing the other said clamping member which is designed to run against the radially inner arm thereof on rocking of said segment bar in a plate releasing direction;

said clamping members are formed with stages spaced out along the well of said cylinder, said stages running into said well from the sides thereof, said pivot and cam shafts for operation of said gripping parts being supported on said stages;

the rails and the segment bar are divided up into a number of lengths, equal to the breadth of such plate, placed end to end along the length of the cylinder; and each part of the divided segment bar has its own such cam shaft, such own cam shafts being plugged into each other.

2. The apparatus as claimed in claim 1 comprising a turning cam shaft supported in said cylinder body, stop means on said bar and means for locking said cam shaft in a desired position of turning thereof and wherein said cylinder body has a stop face against which said stop means of said segment bar may be pushed by said cam shaft.

3. The apparatus as claimed in claim 2 wherein said stop means is in the form of stop lever members spaced out along the length of the segment bar in the direction of the axis of the cylinder body, said lever members running out past said convex base face of said bar and fitting into grooves in said cylinder body, each of said grooves having a stop face for said lever members therein, and said cam shaft having separate cams spaced out in the length direction thereof for driving said levers.

4. The apparatus as claimed in claim 3 wherein said cams have back faces placed at a smaller distance from an axis of turning of said cam shaft than lever-driving faces of said cams so that said lever members may be rocked past said cam shaft over said back faces when same are turned towards said lever members.

5. The apparatus as claimed in claim 2 comprising a plate-like cuff fixed on said cam shaft, a structure on said shaft able to be turned by a tool, said cuff having at least one slot therein, and at least one screw fitting in said at least one slot for locking said cuff in position.

6. The apparatus as claimed in claim 5 wherein said structure on said shaft takes the form of a hexagonal head adapted for use with a spanner.

7. The apparatus as claimed in claim 1 comprising on at least one end of said segment bar a structure adapted to be used with a tool for turning said segment bar and generally lined up with the said axis of turning of said bar.

8. The apparatus as claimed in claim 7 wherein said structure is in the form of a hexagonal head on the end of said segment bar.

9. The apparatus as claimed in claim 1 comprising at least one cheekpiece and means for holding it against an end of said segment bar, said cheekpiece interlocking with said end of said bar at interlocking faces that are curved and parallel to said base face of said segment bar.

* * * * *